US005321219A

United States Patent [19]

Meagher et al.

[11] Patent Number: 5,321,219

[45] Date of Patent: Jun. 14, 1994

[54] LEVER ACTUATED PEDAL OPERATED SWITCH ASSEMBLY

[75] Inventors: James P. Meagher; Donald L. Ray, both of Indianapolis, Ind.

[73] Assignee: Emerson Electric Co., St. Louis, Mo.

[21] Appl. No.: 24,005

[22] Filed: Feb. 26, 1993

[51] Int. Cl.[5] ..... H01H 3/14

[52] U.S. Cl. ..... 200/61.89

[58] Field of Search ..... 200/1 A, 61.89, 865

[56] References Cited

U.S. PATENT DOCUMENTS

| | | | |
|---|---|---|---|
| 3,651,297 | 3/1972 | Jones | 200/302.1 |
| 3,727,015 | 4/1973 | Voland et al. | 200/38 R |
| 3,766,342 | 10/1973 | Stadelmann | 200/61.89 |
| 3,886,953 | 6/1975 | Pope | 131/270 |
| 4,719,444 | 1/1988 | Leigh-Monstevens et al. | 200/61.89 |
| 4,742,193 | 5/1988 | Kassin et al. | 200/61.89 |
| 4,878,041 | 10/1989 | Leigh-Monstevens et al. | 200/61.89 X |
| 4,911,276 | 3/1990 | Leigh-Monstevens et al. | 200/61.89 X |
| 5,162,625 | 11/1992 | Commerford | 200/61.89 |
| 5,241,144 | 8/1993 | Meagher et al. | 200/61.89 |

*Primary Examiner*—J. R. Scott

*Attorney, Agent, or Firm*—Robert F. Meyer; Eric R. Waldkoetter

[57] ABSTRACT

A pedal operated switch assembly has a plunger that operates blade switches and is mounted on a brake pedal in a manner providing self-adjustment. The pedal operated switch assembly has a pivoting lever with a portion that contacts the brake pedal and a portion that contacts a plunger creating a mechanical advantage for actuating the plunger. The mechanical advantage of the pivoting lever reduces the amount of brake pedal travel necessary operate the pedal operated switch assembly.

14 Claims, 9 Drawing Sheets

LEVER ACTUATED PEDAL OPERATED SWITCH ASSEMBLY

BACKGROUND

This invention relates to a vehicle pedal operated switch assembly and more specifically to a self-adjusting switch assembly mounted on an automobile pedal.

Prior art pedal operated switch assemblies have a plunger that is directly displaced by a master cylinder push rod or a brake pedal to operate blade switches. Prior art brake pedal operated switch assemblies require about 0.050 of an inch (0.127 centimeters) free travel prior to operating blade switches. The automobile operator's foot feels approximately five times this distance, about 0.25 of an inch (0.635 centimeters) of travel, because of the brake pedal lever arm.

Brake pedal travel prior to operating switches is undesirable because such travel delays the operation of switches for controlling safety devices such as brake lamps and cruise control deactivation. Additionally brake pedal travel prior to operating switches creates an undesirable loose feel for the automobile operator which can be interpreted as poor quality.

For the foregoing reasons, there is a need to reduce the amount of brake pedal travel necessary to operate a switch assembly mounted on an automobile brake pedal.

SUMMARY

We have invented an apparatus and method that satisfies the need for a self-adjusting automobile pedal operated switch assembly which operates with less brake pedal travel with the following novel features.

The automobile pedal actuated switch assembly apparatus has a housing for attaching and containing components. The housing has an integral mount for attaching the switch assembly to a brake pedal push pin. Blade type switches are contained in the housing, and a spring biased plunger with integral switch activation arms engage the blade switches to open and close contacts. The spring biased plunger is operated by an actuation means which creates a mechanical advantage so less brake pedal travel is required to actuate the plunger. The actuation means includes a lever pivotally mounted in the housing operated by the brake pedal push pin to actuate the plunger.

The method of actuating a plunger in an automobile brake pedal operated switch assembly is achieved by providing a lever having a push pin portion and a plunger end. The lever is carried in the housing so it pivots near the push pin portion, so a mechanical advantage created causes the lever plunger end to move farther than the push pin portion is moved by the brake pedal push pin. By using this method of actuating a plunger in an automobile brake pedal operated switch assembly, less brake pedal travel is necessary to operate blade switches.

The following are objects of the invention. Decrease brake pedal travel necessary to operate a switch assembly mounted on an automobile brake pedal thereby improving automobile brake pedal mounted switch assembly response time and feel when an operator depresses a brake pedal. Provide the advantages described above while at the same time maintaining a compact and self-adjusting mounting design.

BRIEF DESCRIPTION OF THE DRAWINGS

These and other features, aspects, and advantages of the present invention will become better understood with regard to the following description, appended claims, and accompanying drawings where:

DESCRIPTION

Figure 1:
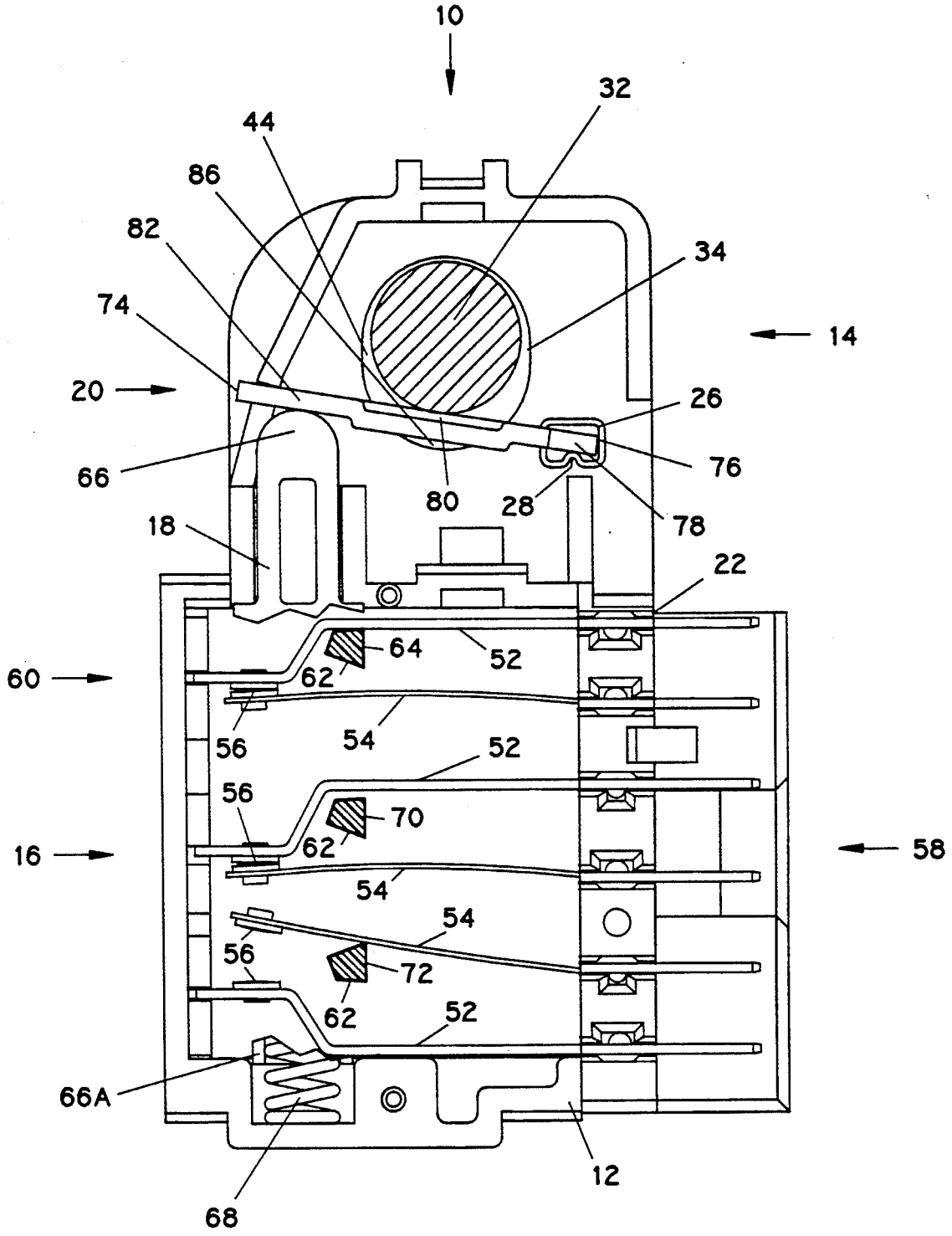
FIG. 1 shows a lever actuated pedal operated switch assembly without a housing cover in a biased position.

Referring to FIG. 1, an installed pedal operated switch assembly 10 is shown. The pedal operated switch assembly 10 includes a housing 12, a mount 14, a plurality of switches 16, a plunger 18, and an actuation means 20.

The housing 12 is molded from a plastic material such as Celeanese® glass mineral filled nylon N-276 material available from Hoechst Celanese Corp. Chatham, N.J. and includes a housing base 22, and a housing cover 24. The housing base 22 includes an actuation means pivot opening 26 having a fulcrum knob 28. The housing cover 24 also includes an actuation means pivot opening 26 and fulcrum knobs 28. The housing cover 24 is fastened over the housing base 22 to enclose the pedal operated switch assembly 10.

Figure 3:
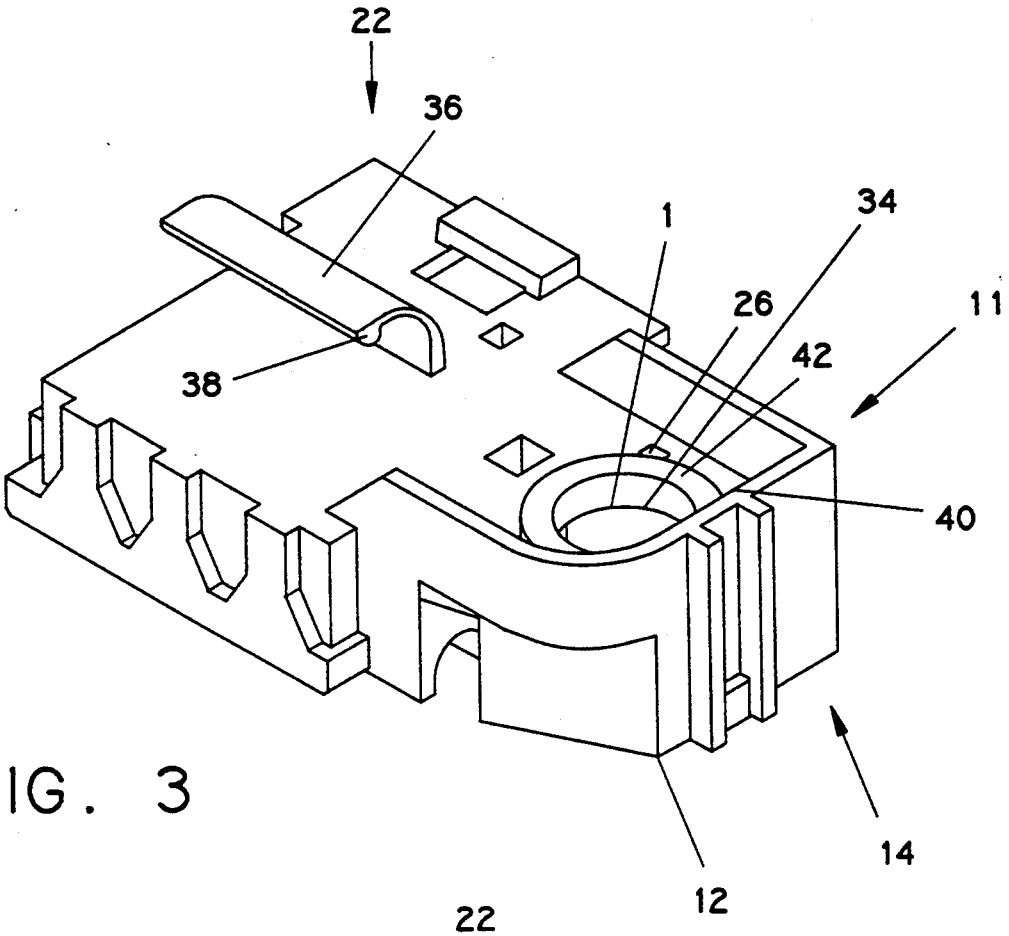
FIG. 3 shows a housing base exterior.
Figure 4:
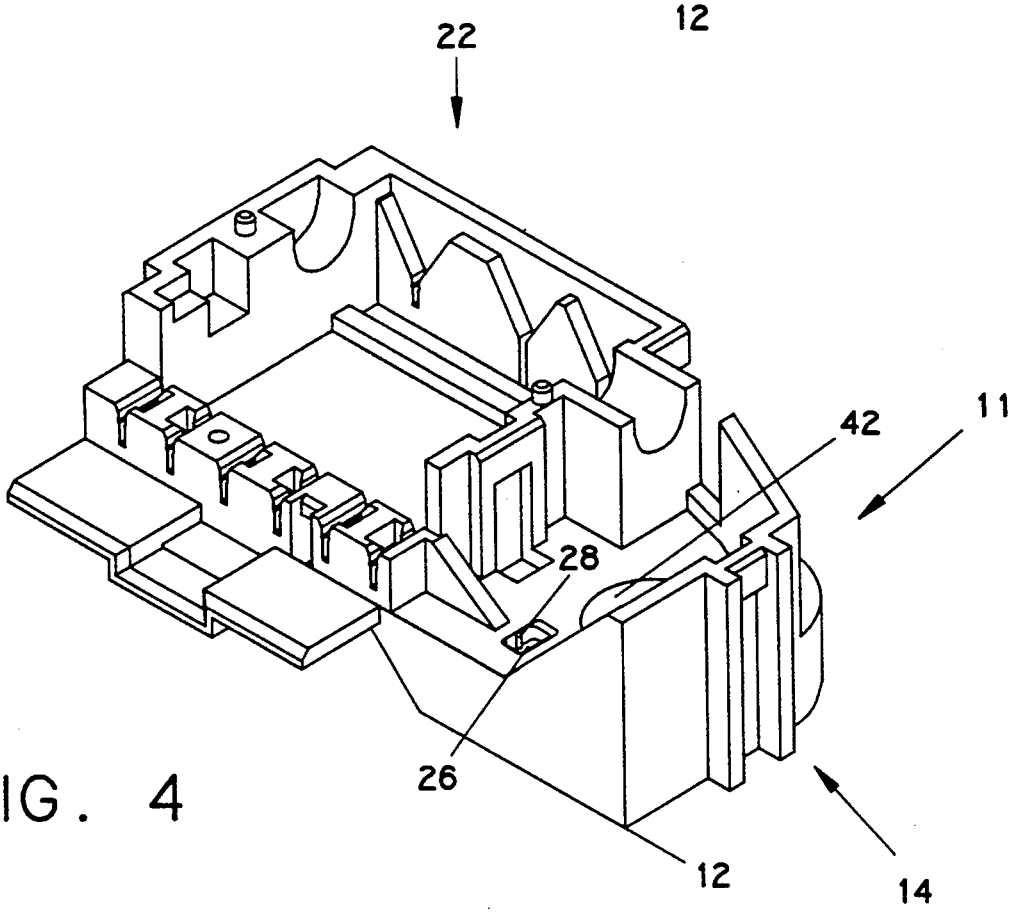
FIG. 4 shows the housing base interior.
Figure 5:
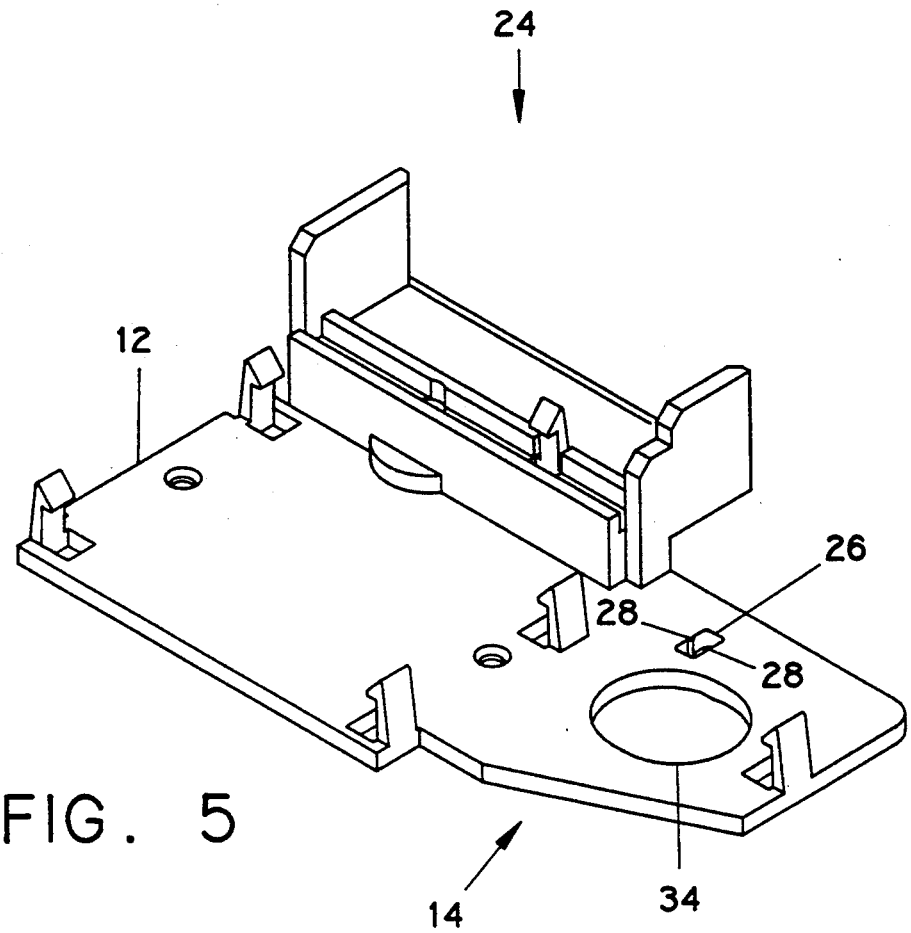
FIG. 5 shows a housing cover interior.
Figure 6:
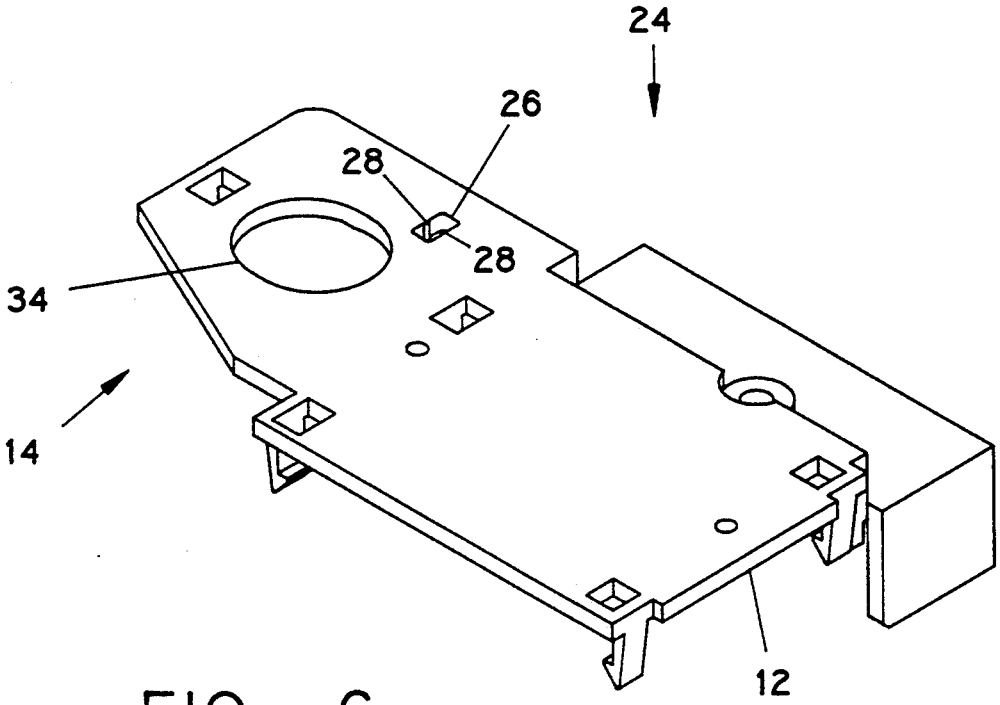
FIG. 6 shows the housing cover exterior.
Figure 7:
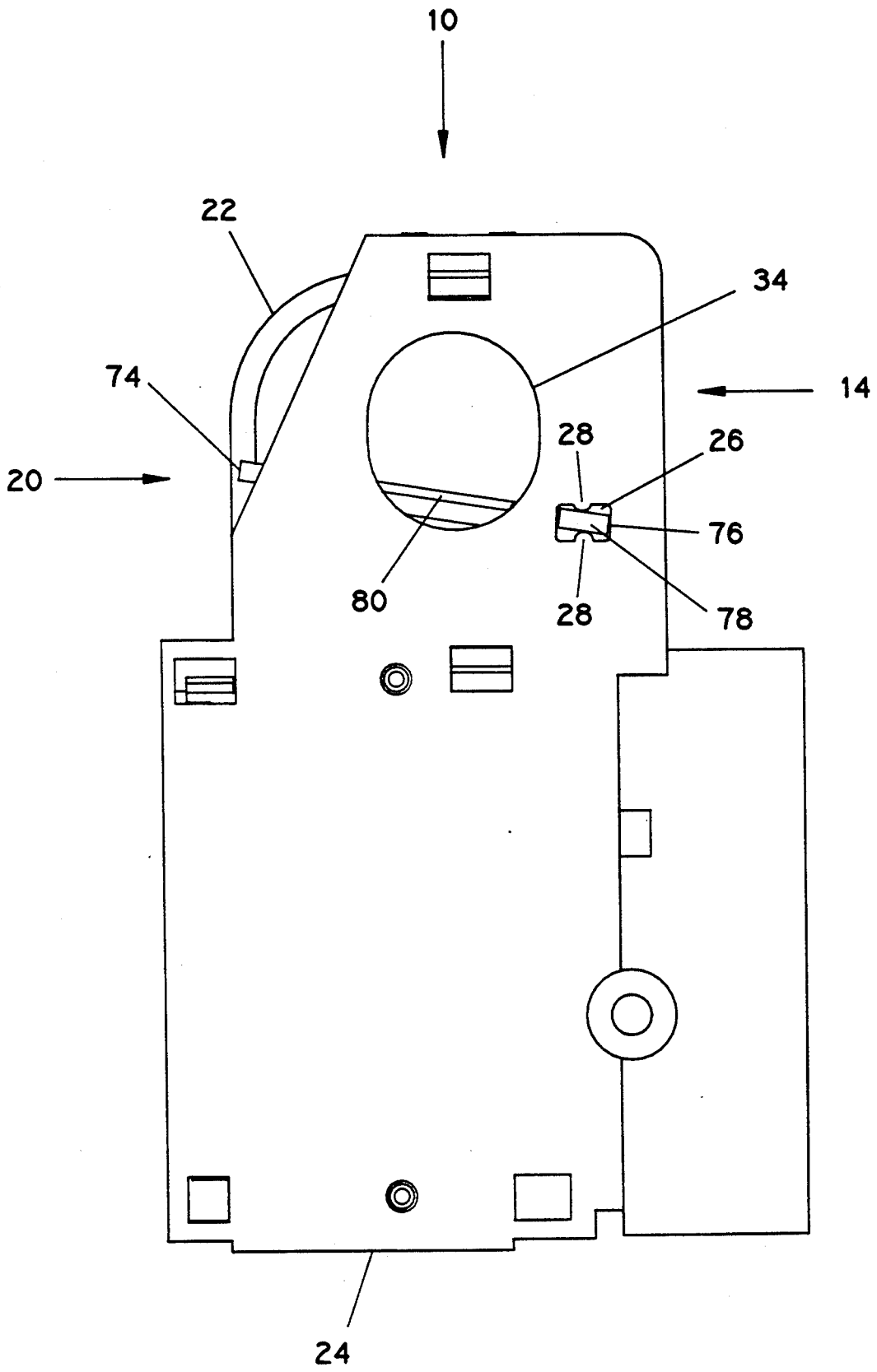
FIG. 7 shows an exterior view of an assembled pedal operated switch assembly.
Figure 8:
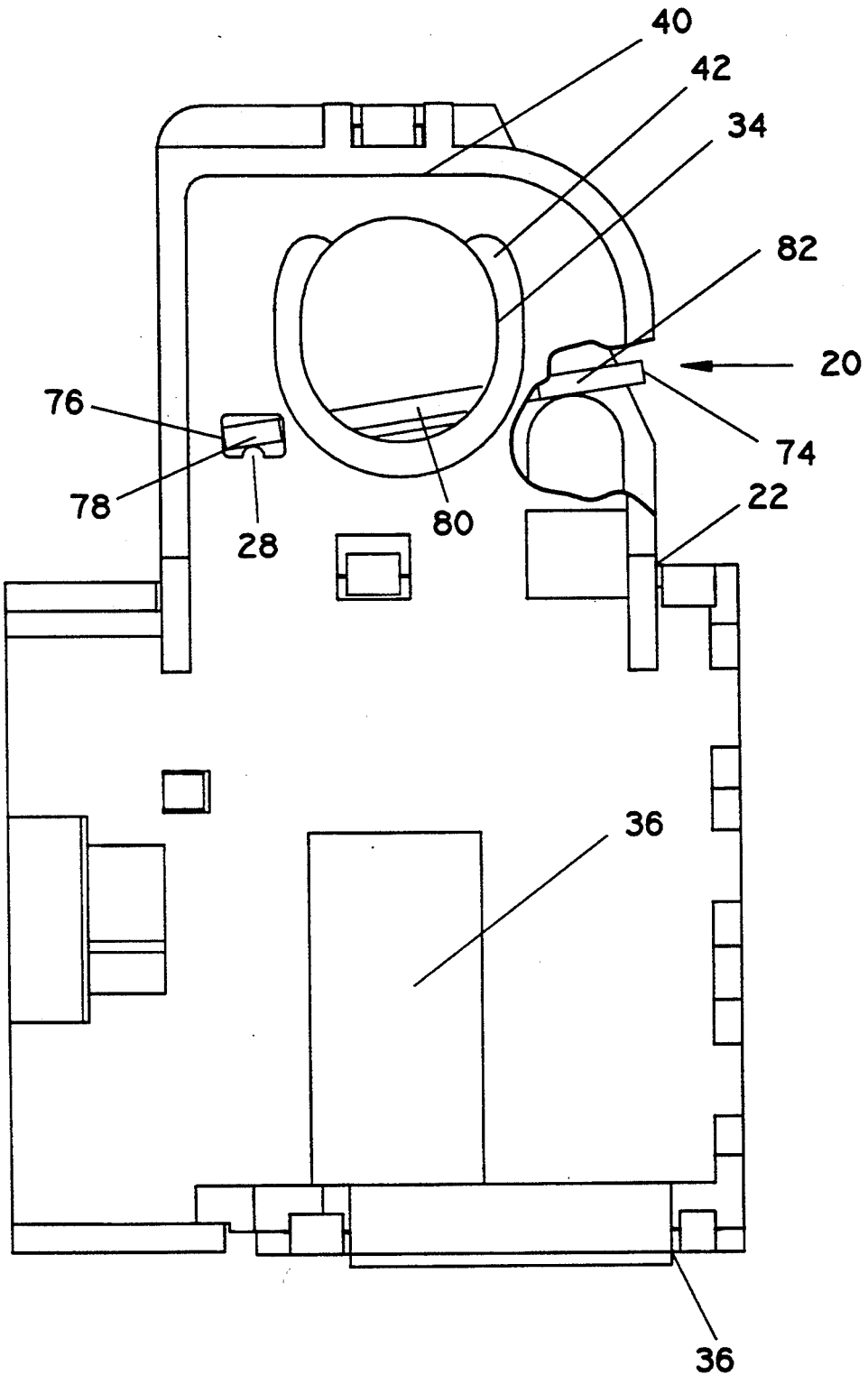
FIG. 8 shows another exterior view of an assembled pedal operated switch assembly.
Figure 9:
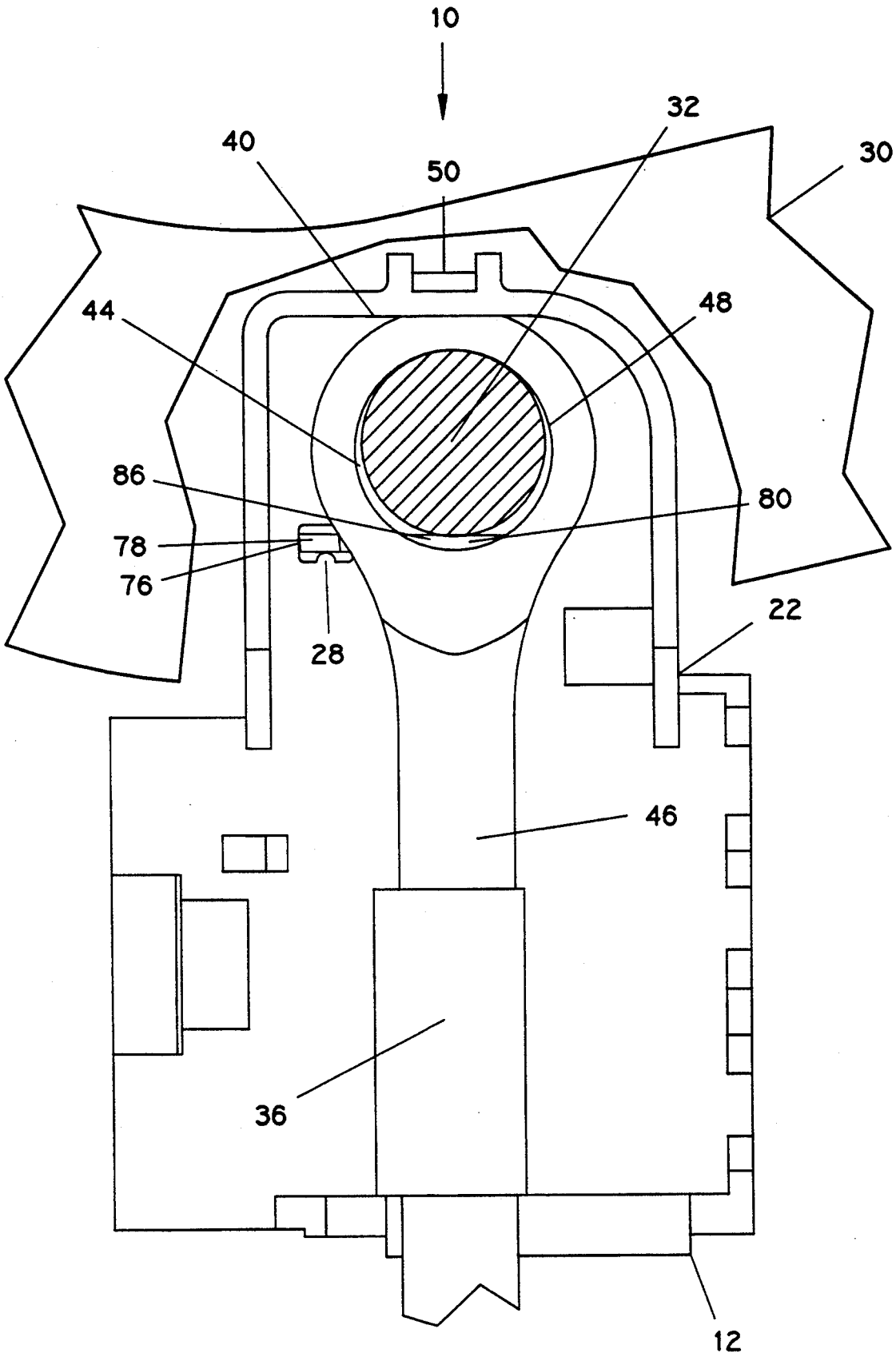
FIG. 9 shows the pedal operated switch assembly with master cylinder push rod installed.

Referring to FIG. 3, the mount 14 is integral to the housing 12 and is used for attaching the pedal operated switch assembly 10 (FIG. 1) on a brake pedal push pin (FIG. 9). The mount 14 includes a push pin opening 34, a push rod retainer 36 with a retention lip 38, a push rod ledge 40 and a boss 42. The mount push pin opening 34 has a larger circumference than the push pin 32 creating a clearance 44. Referring to FIG. 1, the push pin opening 34 is oval to permit movement of the brake pedal 30 push pin 32 when the brake pedal 30 is depressed to operate the actuation means 20 while preventing unnecessary movement of the pedal operated switch assembly 10 on the brake pedal push pin 32.

Referring to FIG. 9, the master cylinder push rod 46 has a push rod opening 48 and a push rod end 50. The push rod opening 48 has a larger circumference than the push pin 32, so there is also clearance 44 between the push rod opening 48 and the push pin 32. The push rod opening 48 diameter is 0.020 to 0.050 inch (0.051 to 0.127 centimeters) smaller than the push pin opening 34. The push rod opening 48 is smaller than the mount push pin opening 34, so the brake pedal push pin 32 will apply braking force to the push rod 46 rather than the brake pedal operated switch assembly 10. By having a clearance between the push rod opening 48 and push pi 32 the period the actuation means 20 is being operated, the master cylinder push rod 46 is prevented from beginning automobile braking until the pedal operated switch assembly 10 is fully operated, and equipment controlled by the pedal operated switch assembly 10 such as brake lamps or a cruise control deactivator have been operate.

The push rod retainer 36 serves to keep the pedal operated switch assembly 10 in proper alignment with the push rod 46, and the retention lip 38 (FIG. 3) secures the master cylinder push rod 46 in the retainer 36. The mount push rod ledge 40 provides a surface on the pedal operated switch assembly 10 for the master cylinder push rod end 50 to contact when the brake pedal push pin 32 is operating the actuation means 20 to hold the pedal operated switch assembly 10 stationary. The master cylinder push rod end 50 is flat to provide a larger surface for contacting the mount push rod ledge 40. The boss 42 (FIG. 3) strengthens the mount push pin opening 34.

The mount 14 attaches the pedal operated switch assembly 10 to the brake pedal push pin 32, after the push rod opening 48 is installed on the push pin 32. The mount 14 is installed by inserting the push pin 32 into the push pin opening 34 on the housing base 22 and sliding the pedal operated switch assembly 10 onto the push pin 32. The pedal operated switch assembly 10 is then positioned so the master cylinder push rod 46 fits in the mount 14 push rod retainer 36. A retention device (not shown) is placed on the brake pedal push pin 32 to further assist in preventing the pedal operated switch assembly 10 from sliding off the brake pedal push pin 32.

Referring to FIG. 1, the plurality of switches 16 are cantilever blade switches and include stationary blades 52, spring blades 54, electrical contacts 56, and terminals 58 that are carried in the housing base 20. The plurality of switches 16 ar arranged in the housing base 20 to provide the greatest beam length to reduce metal fatigue which increases operational life. The brake pedal operated switch assembly 10 can be configured to have a single blade switch 60 carried in the housing base 20 rather than a plurality of switches 16.

Figure 10:
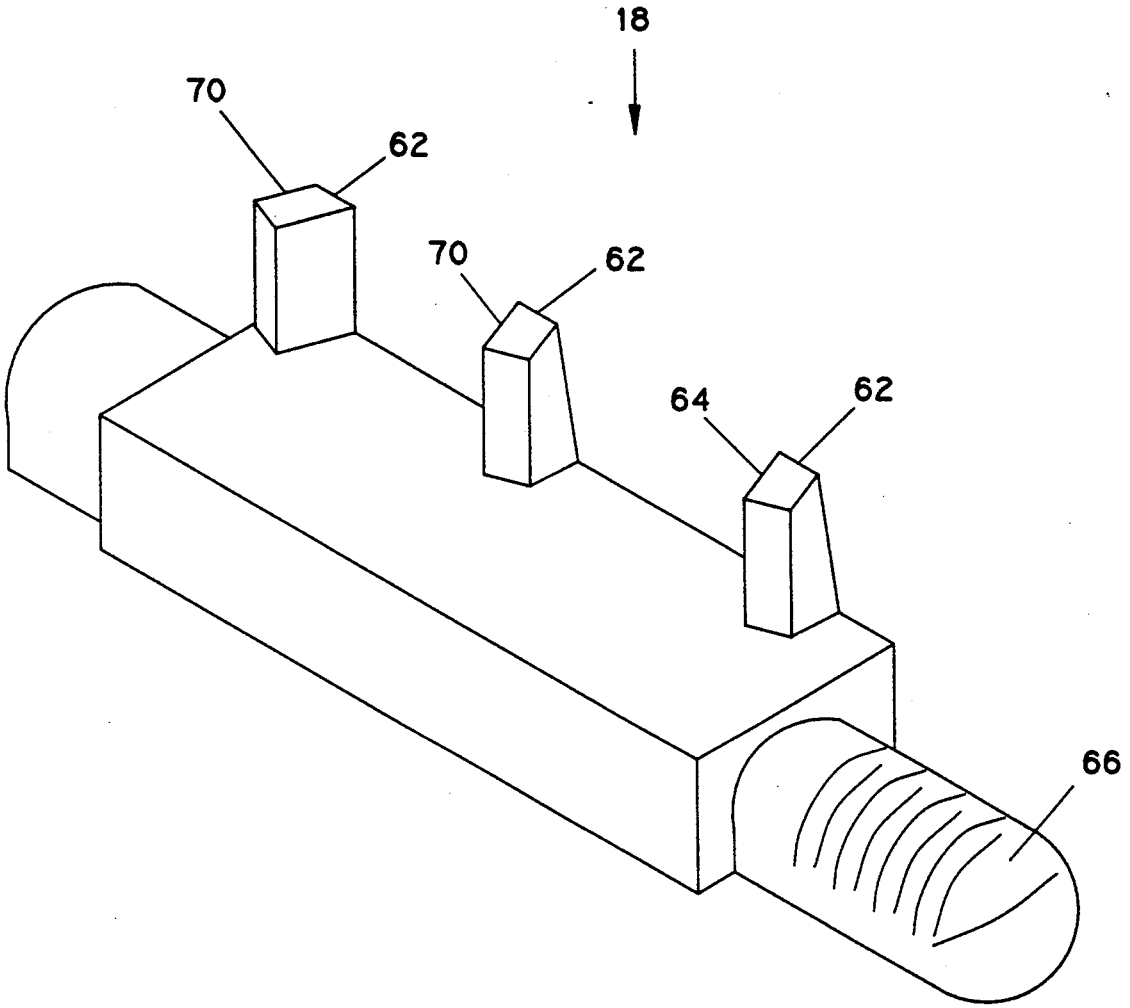
FIG. 10 shows a plunger.
Figure 11:
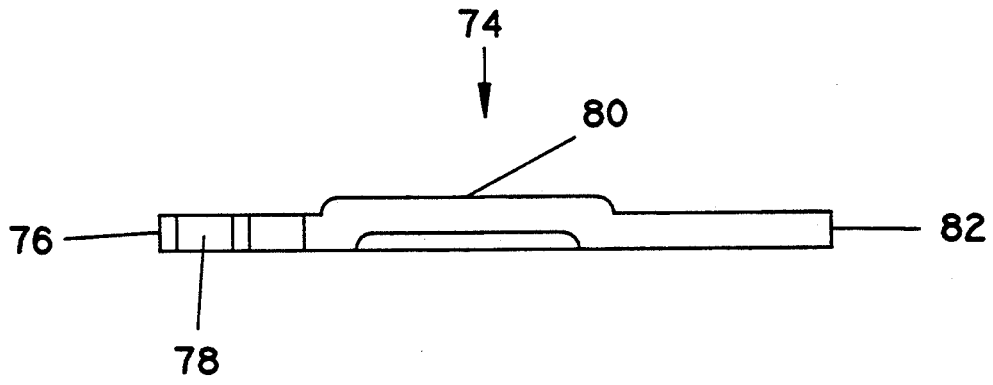
FIG. 11 shows a side view of an actuation lever.

The plunger 18 (FIG. 10) which is spring biased includes switch activation arms 62 integral to the plunger 18 selectively engaging the plurality of switches 16. The plunger 18 could be configured with a single activation arm 64 to selectively engage a single blade switch 60. The plunger 18 is manufactured from a glass-filled polyester which is softer than the housing's 12 Celanese® to provide ease of movement and further includes a plunger head 66, and a plunger spring 68. The plunger head 66 is shaped to provide a radiused contact line. The radiused contact line provides a larger surface for wear than a point contact to reduce plunger head 66 erosion.

The plunger 18 is mounted in the housing base 20 above the electrical contacts 56 so the plunger 18 is a sufficient distance from where the push pin 32 contacts the actuation means 20 to create a mechanical advantage. The mechanical advantage created is approximately 2:1 although the position of the plunger 18 could be changed to create a larger or smaller mechanical advantage. The installed plunger 18 spring 68 provides a 4.5 to 7.5 pound (20.02 to 33.35 Newton) load biasing force. A plunger spring cavity 66*a* partially encloses the plunger spring 68.

Plunger switch activation arms 62 selectively engage the plurality of switches 16 between the electrical contacts 56 and the terminals 58 near a side of the plunger 18 closest to the terminals 58. By engaging the spring blades 54 on the side of the plunger 18 closest to the terminals 58, a mechanical advantage is created in operating the spring blades 54, so less movement of the plunger 18 is required to open and close electrical contacts 56. Plunger switch activation arms 62 include, a middle arm 70 and a tail arm 72 which can be configured to operate spring blades 54 to either open or close electrical contacts 56 upon operation.

Figure 12:
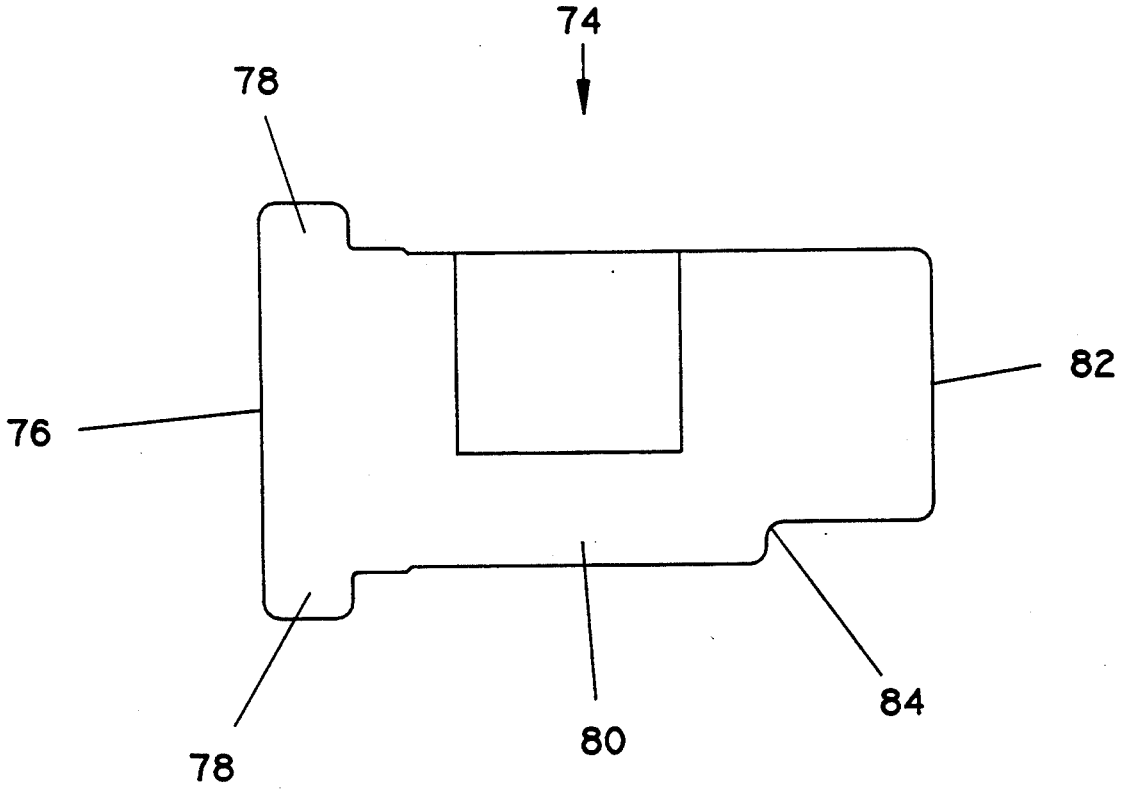
FIG. 12 shows a top-view of the actuation lever.

The actuation means 20 creates a mechanical advantage in operating the plunger 18 to reduce the brake pedal 30 travel necessary to actuate the plunger 18. The actuation means 20 includes an actuation lever 74 pivotally mounted in the housing 12 operated by the brake pedal push pin 32 to actuate the plunger 18. The actuation lever 74 has a pivot end 76 with pivot ears 78 (FIG. 12), a push pin portion 80, a plunger end 82 that engages the plunger head 66, and a housing notch 84 (FIG. 12). The pivot end 76 is mounted in the housing 12 to provide a pivot point when the actuation lever 74 is operated. The pivot end 76 is mounted in the housing 12 by inserting pivot ears 78 (FIG. 12) into the housing pivot openings 26. The fulcrum knobs 28 in each pivot opening 26 provide a radiused surface that contacts the pivot ears 78 (FIG. 12) for ease of movement.

The actuation lever push pin portion 80 engages the brake pedal push pin 32 near where the push pin 32 connects to the brake pedal 30. Having the actuation lever 74 operated by the brake pedal push pin 32 near where the push pin 32 connects to the brake pedal 30 reduces the opportunity for a non-perpendicular push pin 32 to adversely affect operation of the pedal operated switch assembly 10.

The actuation lever 74 plunger end 82 engages the plunger head 66 which biases the actuation lever 74 against the brake pedal push pin 32. Since the mount push pin opening 34 is larger than the diameter of the brake pedal push pin 32, the extended actuation lever 74 maintains contact with the push pin 32 and the portion of the push rod opening 48 opposite the actuation lever 74 also contacts the push pin 32 creating a biased clearance 86. The housing notch 84 (FIG. 12) aids in assembly to prevent the actuation lever 74 from being installed incorrectly.

Thus, the actuation means 20 is accomplished by providing an actuation lever 74 operated by a brake pedal push pin 32 that in turn displaces a plunger 18 at a point farther from the pivot end 76 than where the brake pedal push pin 32 operates the actuation lever 74 creating a mechanical advantage whereby the plunger 18 displaces farther than the brake pedal push pin 32 is depressed during pedal operated switch assembly 10 actuation.

Figure 2:
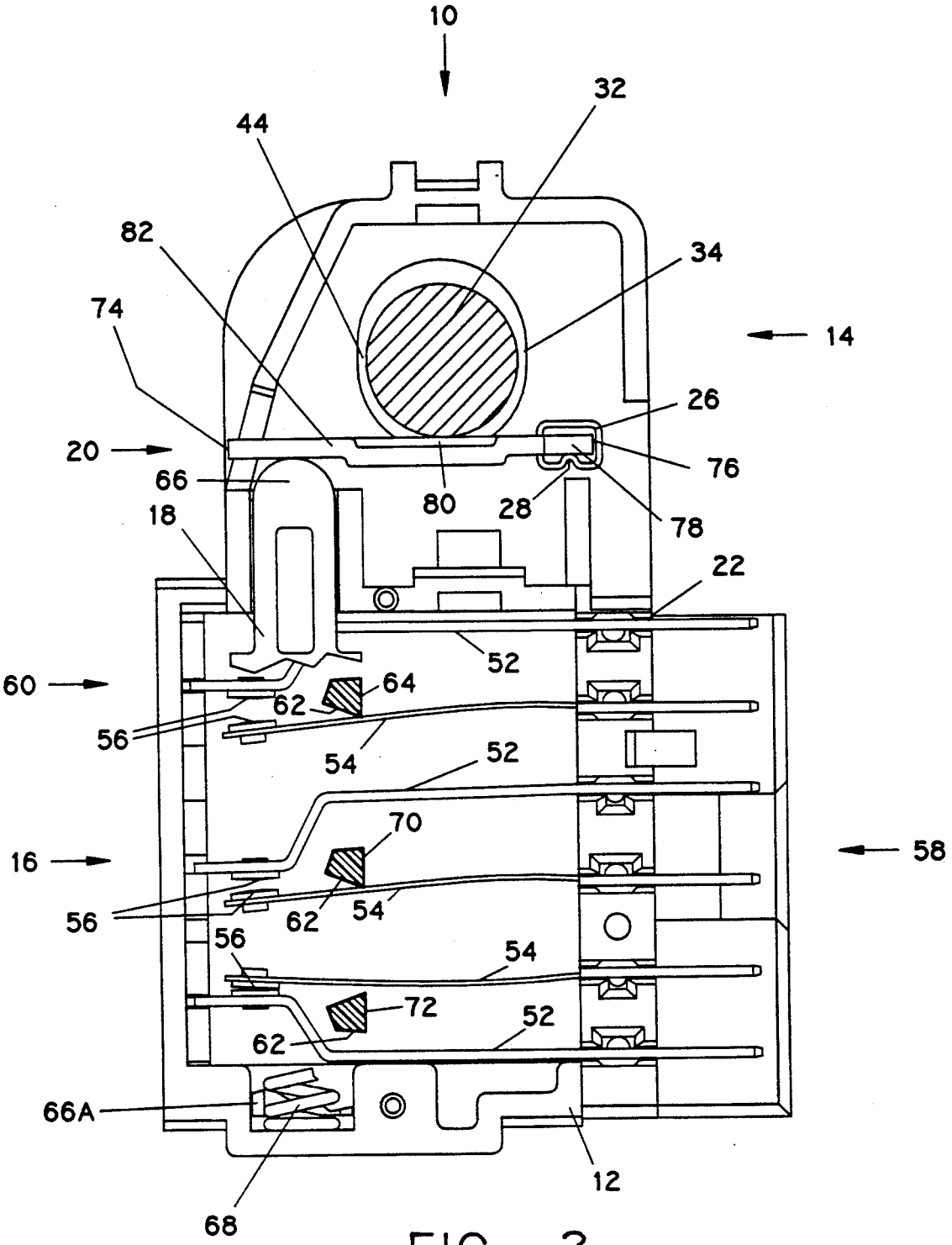
FIG. 2 shows the pedal operated switch assembly without the housing cover in an actuated position.

Operation is now described referring to FIGS. 1 and 2. Since the mount 14 and master cylinder push rod opening 48 have a larger opening than the brake pedal push pin 32, mounting the pedal operated switch assembly 10 and a master cylinder push rod 46 on the brake pedal push pin 32 creates a clearance 44.

By biasing the brake pedal push pin 32 with the spring loaded actuation lever 74 causes the brake pedal push pin 32 to move to a biased position at an edge of the clearance 44 creating a biased clearance 86. The biased clearance 86 is approximately 0.03 of an inch (0.076 centimeters).

Depressing the brake pedal causes the brake pedal 30 push pin 32 to begin moving through the biased clearance 86. During the initial 0.28 inch (0.71 centimeters) the push pin 32 travels, the pedal operated switch assembly 10 and master cylinder push rod 46 remain stationary.

Holding the pedal operated switch assembly 10 stationary while the brake pedal push pin 32 moves through the biased clearance 86 is accomplished with a master cylinder push rod 46 having a spring load higher than the actuation lever 74. The master cylinder push rod end 50 applies force to the housing push rod ledge 40 approximately equal to the force applied to compress the plunger 18 spring 68 to hold the pedal operated switch assembly 10 stationary.

Referring to FIGS. 1, 2 and 9, while the pedal operated switch assembly 10 remains stationary, the brake pedal push pin 32 moves through the biased clearance 86 and at the same time moves the actuation lever 74 push pin portion 80 and the plunger end 82. The actuation lever 74 plunger end 82 displaces the plunger 18 which moves switch activation arms 62 selectively engaging spring blades 54 to open or close electrical contacts 56.

Before the master cylinder push rod 46 can be moved to operate the automobile's brakes, the biased clearance 86 between the push pin 32 push rod opening 48 is taken up. Since the biased clearance between the push pin 32 and the mount 14 push pin opening 34 is larger than the biased clearance between the push pin 32 the master cylinder push rod opening 48, braking force is applied to the master cylinder push rod 46 rather than the mount push pin opening 34.

When the brake pedal 30 is released, the master cylinder push rod 46 spring load returns the brake pedal 30 to a released position and simultaneously the actuation lever 74 spring load applied to the brake pedal push pin 32 returns the brake pedal 30 to the biased position which allows the plunger 18 to return to the plunger 18 biased position creating the biased clearance 86. As the actuation lever 74 returns to the biased position, the plunger 18 switch activation arms 62 apply or release force on spring blades 54 to open or close electrical contacts 56. Also, the master cylinder push rod ledge 40 contacts the push rod end 50 creating the biased clearance 86.

Although the present invention has been described in considerable detail with reference to certain preferred versions thereof, other versions are possible. For example the pedal operated switch assembly 10 could be mounted on a pedal used in a vehicle other than an automobile such as a truck, tractor, or other motorized vehicle.

What is claimed is:

1. An automobile pedal actuated switch assembly, comprising:

(a) a housing;

(b) a mount integral to the housing for attaching the pedal actuated switch assembly o a brake pedal push pin;

(c) at least one blade switch carried in the housing having electrical contacts;

(d) a plunger carried in the housing which is spring biased by a plunger spring having at least one switch activation arm integral to the plunger selectively engaging the blade switch to open or close the electrical contacts; and, (e) an actuation lever pivotally mounted in the housing, spring biased by the plunger, and operated by the brake pedal push pin to actuate the plunger.

2. An automobile pedal actuated switch assembly as recited in claim 1 wherein the actuation lever, comprises:

(a) a pivot end mounted in the housing providing a pivot point when the actuation lever is operated;

(b) an operation portion engaging the brake pedal push pin; and, (c) a lever end engaging the plunger and operated by the brake pedal push pin when a brake pedal is depressed for achieving a mechanical advantage actuating the plunger.

3. An automobile pedal actuated switch assembly as recited in claim 1 wherein there are integral switch activation arms.

4. The automobile pedal actuated switch assembly as recited in claim 2 wherein the actuation lever operation portion is raised to engage the brake pedal push pin near where the brake pedal push pin attaches to the brake pedal reducing the opportunity for a non-perpendicular brake pedal push pin to adversely affect operation of the automobile pedal actuated switch assembly.

5. The automobile pedal actuated switch assembly as recited in claim 1 wherein the plunger selectively engages the blade switch when the plunger axially displaces.

6. The automobile pedal actuated switch assembly as recited in claim 1 wherein the plunger is positioned over a portion of the electrical contacts.

7. The automobile pedal actuated switch assembly as recited in claim 6 wherein the switch activation arm selectively engages the blade switches between the electrical contacts and a terminal.

8. The automobile pedal actuated switch assembly as recited in claim 7 wherein the switch activation arm operates the blade switch on a spring blade at least seventy percent of the distance from where the spring blade pivots to the electrical contacts.

9. The automobile pedal actuated switch assembly as recited in claim 1 wherein the plunger spring is a coil spring positioned between the housing and the plunger.

10. The automobile pedal actuated switch assembly as recited in claim 1 wherein the blade switch comprises at least three blade switches.

11. The automobile pedal actuated switch assembly as recited in claim 1 wherein the brake pedal push pin provides braking force directly to the master cylinder push rod.

12. In an automobile pedal operated switch assembly a method of actuating a plunger, comprising the steps of:

(a) providing a housing, having an integral mount for attaching the automobile pedal operated switch assembly to a brake pedal push pin, at least one blade switch carried in the housing having electrical contacts, a plunger carried in the housing having at least one switch activation arm integral to the plunger selectively engaging the blade switch wherein the plunger is biased by a plunger spring;

(b) providing an actuation lever pivotally mounted in the housing, spring biased by the plunger, and operated by the brake pedal push pin to actuate the plunger;

(c) mounting the pedal operated switch assembly and a master cylinder push rod on the brake pedal push pin wherein a mount push pin opening and a master cylinder push rod opening have a larger circumference than the brake pedal push pin creating a clearance;

(d) biasing the brake pedal push pin with the actuation lever having a spring load provided by a plunger spring against the brake pedal push pin to create a biased clearance;

(e) depressing a brake pedal causing the brake pedal push pin to begin moving through the biased clearance;

(f) holding the pedal operated switch assembly stationary while the brake pedal push pin moves through the biased clearance with the master cylinder push rod having a spring load higher than the actuation lever;

(g) moving the brake pedal push pin through the biased clearance and at the same moving the actuation lever push pin actuation portion and the plunger end; and, (h) displacing a plunger with the plunger end of the actuation lever which moves switch activation arms selectively engaging spring blades to open or close contacts.

13. The method as recited in claim 12, further comprising the step of:

(i) releasing the brake pedal causing the master cylinder push rod spring load to return the brake pedal to a released position and simultaneously the actuation lever spring load applied to the brake pedal push pin returns the brake pedal to he biased position creating the biased clearance.

14. The method as recited in claim 12 wherein the mechanical advantage is about 2:1.

* * * * *